United States Patent [19]

Gaston

[11] 4,385,968

[45] May 31, 1983

[54] ELECTROPLATING A SIMULATED BRIGHT BRASS FINISH

[75] Inventor: David E. Gaston, Reseda, Calif.

[73] Assignee: Brooktronics Engineering Corporation, North Hollywood, Calif.

[21] Appl. No.: 302,804

[22] Filed: Sep. 16, 1981

Related U.S. Application Data

[63] Continuation of Ser. No. 143,820, Apr. 23, 1980, abandoned.

[51] Int. Cl.[3] ..... C25D 5/06; C25D 5/10; C25D 5/34; C25D 5/52

[52] U.S. Cl. ..... 204/36; 204/15; 204/40; 204/43 G

[58] Field of Search ..... 204/36, 40, 15, 43 R, 204/43 G, 224 R

[56] References Cited

U.S. PATENT DOCUMENTS 3,755,089 8/1973 Rapids ..... 204/15
4,121,982 10/1978 Moriarty et al. ..... 204/43 G

OTHER PUBLICATIONS

Marv Rubinstein, Plating, pp. 540–550, Jun. 1972.
David Fishlock, "Metal Colouring", pp. 113–114, (1962).

*Primary Examiner*—G. L. Kaplan
*Attorney, Agent, or Firm*—Gene W. Arant

[57] ABSTRACT

A simulated bright brass finish is produced by electroplating onto a metal base a gold-silver alloy coating having a thickness of the order of one ten-thousandth of an inch. The gold content of the coating is about five parts by weight for each four parts of silver. The surface of the coating is polished.

1 Claim, 3 Drawing Figures

ELECTROPLATING A SIMULATED BRIGHT BRASS FINISH

RELATED APPLICATION

This application is a continuation of application Ser. No. 143,820 filed Apr. 23, 1980 and subsequently abandoned.

BACKGROUND OF THE INVENTION

There are three principal methods of electroplating. The first and most commonly used method involves immersing the object to be plated in a bath of electrolyte solution and passing an electrical current between the electrolyte and the object. According to a second method the object to be plated is immersed in a bath but no electrical current is used; this is referred to as electroless plating. In a third method, known as brush plating, no plating tank or bath is used and instead the electrolyte solution is applied to the surface of the object to be plated by means of a brush which also acts as an electrode for conducting current through the electrolyte to the object.

Many objects which need to have a plated surface either for purpose of protection or for decorative appearance, or both, cannot be conveniently transported to and immersed within a plating tank. As one example, bathroom plumbing fixtures frequently have metal parts that are permanently installed and cannot be conveniently removed; hence if the entire set of metal parts is to be refurbished by means of electroplating, it is necessary to accomplish the electroplating at the site.

As is well-known, brass is not a pure metal but is an alloy of copper and zinc, usually containing more than 50% copper. A characteristic of brass is that its surface when exposed to air tends to corrode and become discolored. Therefore, it has been a common practice to finish the surface of a metallic member by covering it with brass plate, and then in turn to cover the brass plate with a thin layer of transparent plastic material. This does provide effective protection on a temporary basis, but when the plastic coating wears through, as it eventually does, the brass plating is then exposed to air and becomes discolored.

A need has therefore developed for applying a decorative brass finish that will not corrode or discolor. The problem is particularly acute when the nature of the object to be plated is such that it cannot be conveniently transported to and immersed within a conventional plating tank.

SUMMARY OF THE INVENTION

According to the present invention a simulated bright brass finish is achieved, not by applying the copper and zinc which constitute true brass, but by applying instead an alloy of gold and silver. By selecting the proper proportion of these precious metals the true appearance of bright brass is achieved. At the same time the resulting finish is free from corrosion and does not require the additional protection of a plastic coating.

Further in accordance with the present invention the object to be plated is first preferably covered with a preplate coating such as bright nickel, and the finish coating alloy is provided with about five parts by weight of gold for each four parts of silver. The cost of the finish coating is not excessive because a thickness of the order of one-ten thousandth of an inch is sufficient.

According to another feature of the invention the known technique of brush plating is utilized, and an appropriate electrolyte solution is selected which contains a far higher concentration of gold than will actually become part of the plated alloy. Specifically, a ratio by weight of about eight parts of gold to one part of silver in the electrolyte is preferred.

DRAWING SUMMARY

DETAILED DESCRIPTION

According to the present invention it has been discovered that the decorative appearance of bright brass may be simulated by an electroplated surface coating of a gold-silver alloy which consists of about five parts by weight of gold to four parts by weight of silver. It has also been discovered according to the invention that this surface coating may be effectively applied by means of brush plating.

Figure 1:
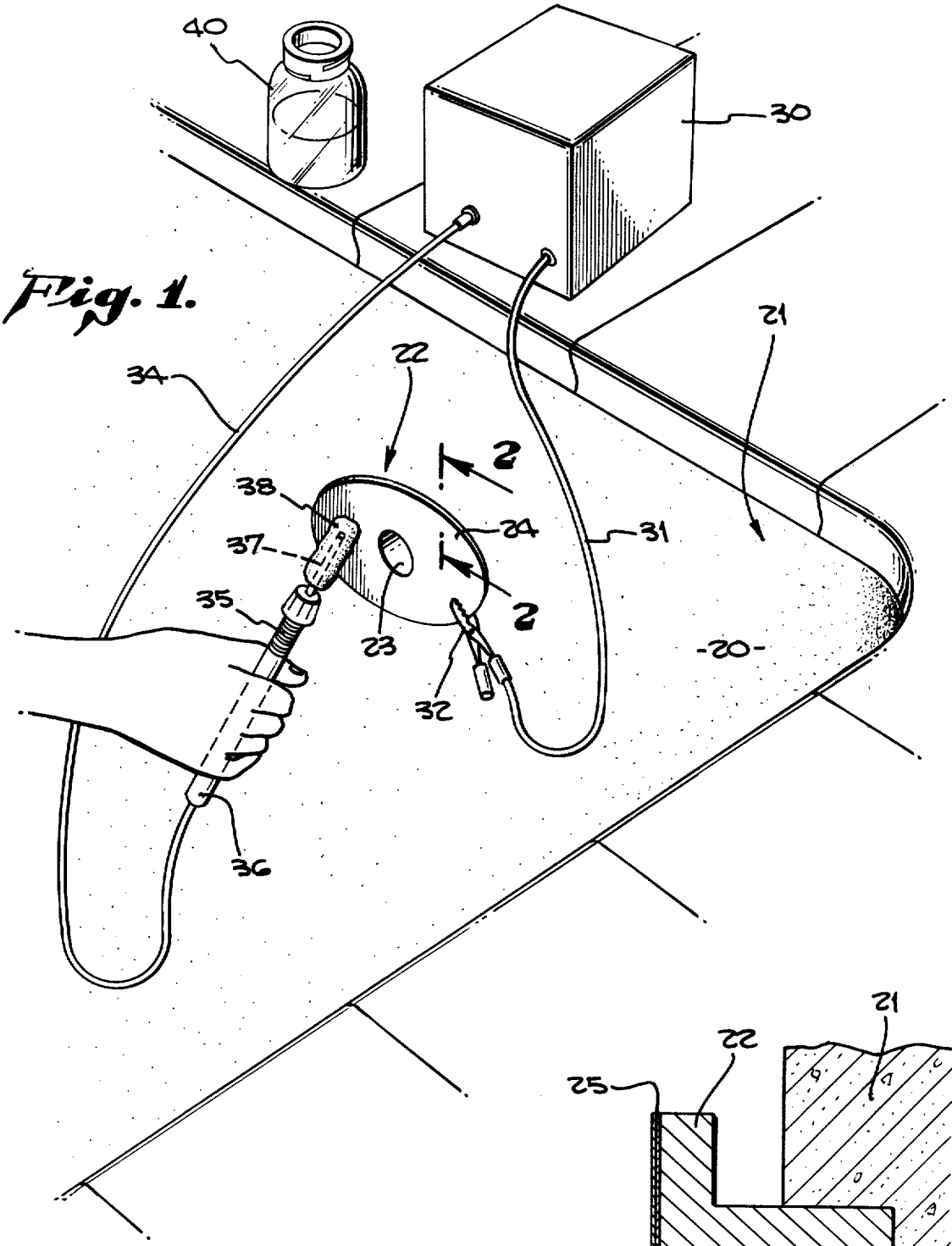
FIG. 1 is a perspective view of a portion of a jacuzzi tub showing a plumbing fixture in one end wall of the tub being plated in accordance with the present invention.

As shown in FIG. 1 a tub 20 of the jacuzzi type has an end wall 21 in which a water inlet fixture 22 is permanently mounted. Fixture 22 has a central opening or passageway 23 through which water enters the tub. The fixture 22 also has a flat circular metal face 24 which surrounds the opening 23.

As shown in FIG. 1, the metal surface 24 is being coated in accordance with the present invention to provide a simulated bright brass finish. The surface 24 has previously been plated with a layer 25 of bright nickel; see FIG. 2. Then a surface coating 26 of gold-silver alloy is applied, this finish coating being for convenience presently designated as Electrum.

Also shown in FIG. 1 is conventional brush plating apparatus which is being used to perform the brush plating in accordance with the present invention. A DC generator 30 preferably has a no-load output voltage of about nine volts. Its negative output lead 31 is connected by means of an alligator clip 32 to one edge portion of the circular plate 24. Its positive output lead 34 extends to a conventional electroplating brush 35. Brush 35 has an insulating handle 36. It also has a tip 37 in the form of an elongated rod of pure graphite or carbon. The forward portion of the carbon tip 37 is completely surrounded and covered by a wad of cotton 38. A bottle 40 conveniently positioned at one end of the tub contains the Electrum electrolyte used in the plating process.

Figure 2:
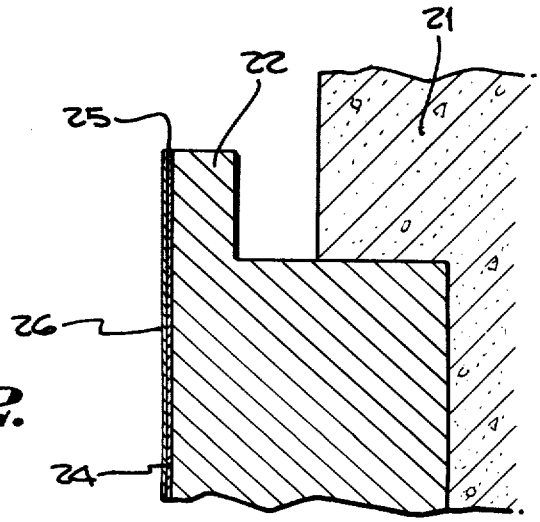
FIG. 2 is a cross-sectional view of the plated metal fixture taken on line 2—2 of FIG. 1.

In the example shown in FIGS. 1 and 2 the underlying or base metal of the fixture 22 is brass. The brass has been preplated with a coating 25 of bright nickel having a thickness of at least about one ten-thousandth of an inch before the Electrum is applied.

Figure 3:
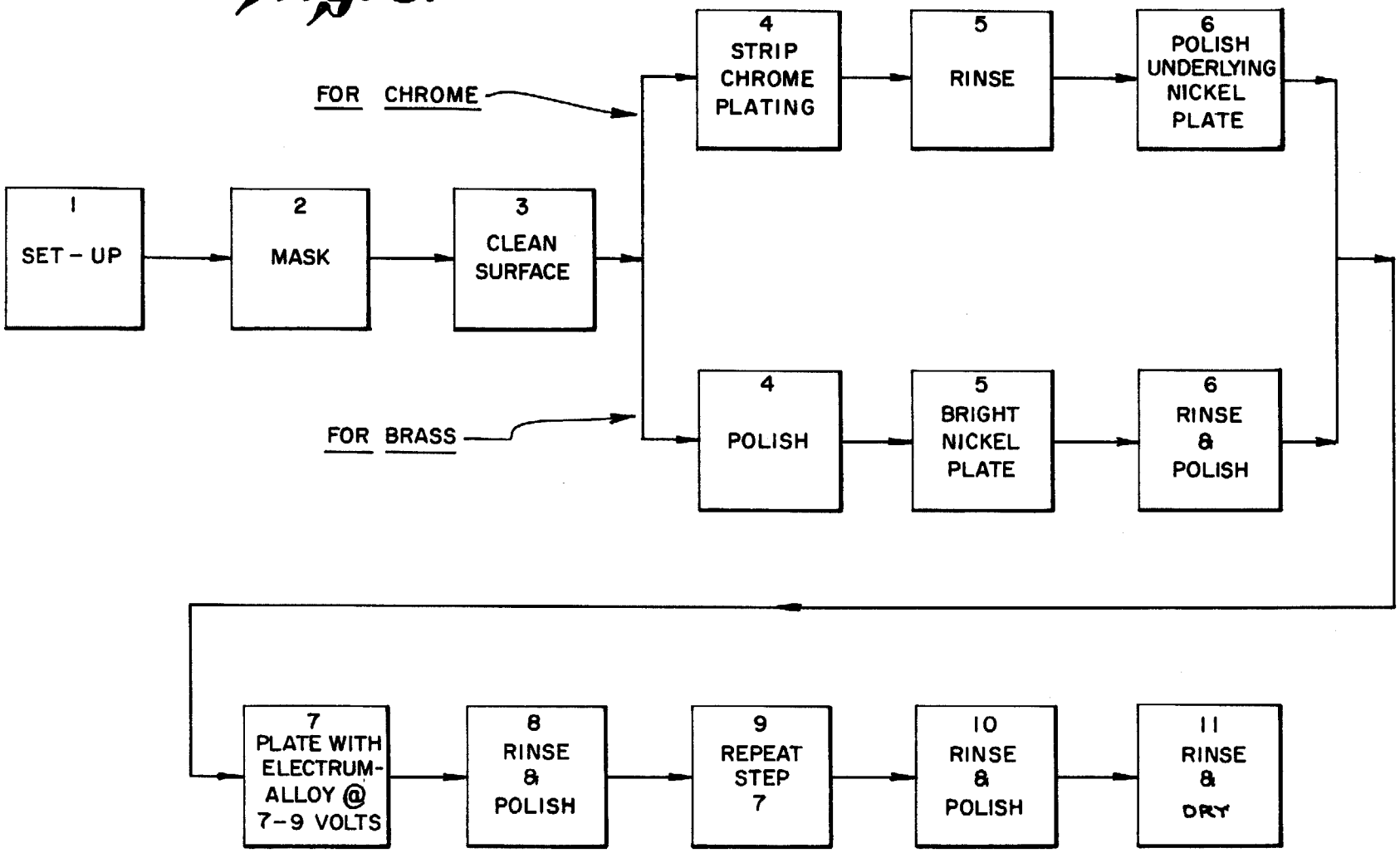
FIG. 3 is a schematic block diagram illustrating the steps involved in carrying out the plating method of the present invention.

Reference is now made to FIG. 3 illustrating a general form of the plating process in accordance with the present invention. Step 1 is to set up the equipment including particularly the generator 30. Then in step 2 any surface portions that are to be protected from the plating process are masked by conventional means. In step 3 the surface to be plated is then cleaned, again by conventional means.

The next step to be taken depends upon whether the surface to be plated is brass or chromium. If it is chrome, step 4 is to strip the chrome plating from the underlying base metal. This is done by utilizing a chemical solution that is known to be useful for that purpose. Since chrome is invariably plated over a nickel coating, the next step after stripping the chrome is to rinse the underlying nickel plate. Then in step 6 the nickel plate is polished. All is now ready for application of the gold-silver alloy, or Electrum finish.

If the metal to be plated was brass, then step 4 is the polishing of the surface. In step 5 a preplate coating of bright nickel is applied. Then in step 6 the nickel coating is rinsed and polished. Again, all is ready for application of the final coating.

In step 7 the Electrum, or gold-silver alloy, is plated onto the surface using a no-load generator voltage of about seven to nine volts. The brush 35 is moved back and forth for about ten to twenty seconds with its cotton wad 38 in contact with the surface to be plated. Then the cotton wad is again dipped in the solution in the bottle 40 in order to renew its supply of electrolyte.

Step 8 is to rinse and polish the surface after the first layer of the finish coating is applied. Then in step 9 the plating brush 35 is again utilized to add another layer to the finish coating. Then in steps 10 and 11 the surface is rinsed and polished, and then rinsed and dried.

In accordance with the present invention the polishing of the deposited alloy is preferably accomplished using a very fine powdered aluminum oxide. A slightly damp paper towel is dipped into the white aluminum powder and then rubbed over the plated surface. The paper towel then turns to a blackish color. Before polishing, the deposited surface looks like burnt gold, being of a very matte or dark orange color. After polishing it then assumes the bright brass appearance.

The presently preferred formula for the electrolyte is as follows:

| | |
|---|---|
| 47 g $KAu(CN)_2$ | Potassium gold cyanide |
| 1 g Cobalt Cyanide | |
| 5 g Ag(CN) | Silver Cyanide |
| 4.5 g KCN | Potassium Cyanide |
| 0.5 g KOH | Potassium Hydroxide |
| 0.4 g $K_2CO_3$ | Potassium Carbonate (anhydrous) |

Sufficient water is added to make one quart of the solution.

The voltage and current applied to the electrolyte must be controlled within fairly close limits. If the no-load voltage developed by generator 30 is nine volts, then when the application of the cotton wad 38 to circular face 24 completes the plating circuit the voltage delivered across the output leads 31, 34 will drop to about seven and one-half volts. But if the no-load voltage is set at seven volts then the voltage delivered under load will drop to about six volts. The voltage delivered to the plating circuit under load should be kept within the range of about six volts to about seven and one-half volts.

It will be noted that in the preferred form of the electrolyte as set forth above the ratio of the weight of pure metallic gold to pure metallic silver is about eight to one. The gold alloy coating that is electroplated to provide the desired surface finish has a much lower concentration of gold. Specifically, in the alloy the ratio by weight of gold to silver is about five to four. It can range from as low as about one to one or as high as about three to two, but if the ratio varies substantially beyond those limits then the simulated bright brass appearance cannot be achieved.

It should be noted that polishing of the final surface appears essential in order to provide the bright brass appearance. The gold-silver alloy when initially deposited tends to be rough and matte, and the thicker the deposit the more rough and matte it becomes. Hence in accordance with the invention it is desirable that each layer of the gold-silver alloy be initially deposited with a thickness of not more than one ten-thousandth of an inch, and preferably a rather small fraction of that thickness. The initial layer is then polished before another layer is applied over it. In this way a very smooth surface is achieved, which also has excellent light reflection capabilities and hence has quite a bright appearance. The brassy color of the finish is determined largely by the ratio of gold and silver in the alloy of the coating but is also determined to some extent by the polishing of the surface. The final thickness of the alloy should be of the order of one ten-thousandth of an inch.

In the electroplating action the silver tends to be deposited much more rapidly than the gold, which accounts for the higher ratio of silver in the alloy than is present in the electrolyte. The difference in the deposition rates is due to differences in the voltage that is required to separate the metal atom from the anion. While pure gold is lower in the electromotive force series than pure silver, and hence is easier to electrodeposit, the same is not true for the metals as contained in the electrolyte solution. Loading the gold and silver molecules with cyanide tends to bring their electromotive force requirements closer together so that they will be deposited concurrently. And the gold cyanide ion is more difficult to reduce than the silver cyanide ion. More specifically, for the solution concentrations that are achieved in the electrolyte as described above the voltage required to convert a silver cyanide complex to metallic silver is somewhat less than the voltage required to convert a gold cyanide complex to metallic gold. Hence the plating conditions are such that both metals are electrodeposited concurrently, forming an alloy, but since a lower voltage is required to deposit the silver the resulting concentration of silver in the alloy is much greater than it was in the electrolyte.

After each layer of gold-silver alloy is deposited the resulting surface is then rinsed, as shown by the flow chart of FIG. 3. It appears that the rinsing may very well carry away some gold particles that were present in the electrolyte but which did not become part of the alloy. In addition to this apparent loss of some of the gold through run-off there is also a build-up of gold in the electrolyte. Stated conversely, after a substantial portion of the liquid in the electrolyte container has been used there is a depletion of the silver concentration then remaining in the electrolyte. It may therefore be desirable from time to time to check the level of silver concentration in the electrolyte and replenish it as needed.

It will be recognized that there are quite a number of variables involved in the plating process and that all of them must be controlled within reasonably precise limits. For example, the voltage setting on generator 30 not only determines the total amount of plating current that will flow, but also influences the rate of deposition of metallic silver relative to the rate of deposition of metallic gold. The operator must be alert for unbalances that will affect the end result. When the resulting surface has too much orange color that indicates that the gold content in the alloy is too great. If the resulting color is too whitish or too greenish, or is pale yellow, that indicates that the silver content of the alloy is excessive. There is a certain amount of artistry involved in operating the brush plating equipment, and a certain amount of experience by the operator is necessary in order to achieve the best result.

It will be noted that the presently preferred electrolyte is a rather dilute solution compared to other brush plating solutions. This appears advantageous for two reasons. First, the value or cost of precious metals being used in the plating process can be carefully limited and controlled. And second, the low concentrations of the precious metals in the electrolyte solution provides the operator a much better control over the nature and quality of the finish coating that is being plated.

As far as the electrolyte solution is concerned, many variations are possible but the permissible limits of such variations are not precisely known at the present time. It is possible, for example, to substitute nickel cyanide for the cobalt cyanide. The potassium hydroxide and potassium carbonate function to keep the solution strongly basic, that is, with a high pH value. The potassium ion is not reduced in the electroplating process, but its use is convenient because potassium compounds are very soluble, and the presence of the potassium produces an excess of cyanide which is needed in the electrolytic reduction process.

The purpose of the cobalt in the electrolyte solution is to increase the hardness of the deposited alloy. Therefore, a small amount of the cobalt does become reduced from the solution and hence included in the alloy. The other ingredients of the plating solution, however, do not show up in measurable quantities in the alloy coating.

It is believed that by varying the other ingredients of the electrolyte, and also varying the plating conditions, it may be possible to reduce the gold-silver ratio in the electrolyte to as low as 5:1 or to raise it as high as 10:1.

It will be noted that during the brush plating process as utilized in carrying out the present invention the carbon anode tip 37 is not progressively dissolved by the flow of plating current. The process differs in this respect from many tank plating processes wherein a metal anode is used, and the metal of the anode is progressively dissolved as plating continues.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. The method of brush plating a metallic member to provide an ornamental and corrosion-free surface having the appearance of bright brass comprising the steps of:

selecting a metallic workpiece to be brush plated;

electroplating a preplate coating of bright nickel on said workpiece;

preparing an aqueous alkaline brush plating electrolyte solution including gold and silver in the proportion of about 8 to 1 parts by weight and also including either cobalt cyanide or nickel cyanide;

applying said electrolyte solution to said workpiece by brushing said electrolyte solution on said workpiece with an applicator which comprises a carbon rod in the presence of an electric current using an applied plating voltage of about six to seven and one half volts to electroplate a coating of gold-silver alloy on said workpiece;

the proportions of gold to silver in said alloy being about 5 to 4 parts by weight, said alloy also including a small amount of cobalt or nickel, the thickness of said coating being no more than about one ten-thousandth of an inch;

rinsing and polishing said coating to produce a smooth surface on said coating; and repeating and applying, rinsing and polishing steps at least once to produce a coating having a thickness of approximately one ten-thousandth of an inch.

* * * * *